US008016555B2

(12) United States Patent
Maltson

(10) Patent No.: US 8,016,555 B2
(45) Date of Patent: Sep. 13, 2011

(54) TURBOMACHINE

(75) Inventor: John David Maltson, Skellingthorp (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/680,791

(22) PCT Filed: Sep. 1, 2008

(86) PCT No.: PCT/EP2008/061508

§ 371 (c)(1),
(2), (4) Date: Mar. 30, 2010

(87) PCT Pub. No.: WO2009/043659

PCT Pub. Date: Apr. 9, 2009

(65) Prior Publication Data

US 2010/0221103 A1 Sep. 2, 2010

(30) Foreign Application Priority Data

Oct. 1, 2007 (GB) ..... 0718997.0

(51) Int. Cl.
*F04D 29/58* (2006.01)

(52) U.S. Cl. ..... 415/178; 415/179

(58) Field of Classification Search ..... 415/177, 415/178, 179
See application file for complete search history.

(56) References Cited

U.S. PATENT DOCUMENTS

| | | | |
|---|---|---|---|
| 3,476,396 | A | 11/1969 | Buhl |
| 3,648,082 | A | 3/1972 | MacNab |
| 4,784,574 | A | 11/1988 | Tsuno et al. |
| 5,252,026 | A | 10/1993 | Shepherd |
| 5,469,817 | A | 11/1995 | Hoag |
| 2003/0143064 | A1 | 7/2003 | Lafarge et al. |

FOREIGN PATENT DOCUMENTS

| | | | |
|---|---|---|---|
| DE | 1231798 | B | 1/1967 |
| EP | 1004759 | A2 | 5/2000 |
| EP | 1734292 | A1 | 12/2006 |
| GB | 775454 | A | 5/1957 |
| GB | 866710 | A | 4/1961 |
| JP | 58005403 | A | 1/1983 |

*Primary Examiner* — Edward Look
*Assistant Examiner* — Dwayne J White

(57) ABSTRACT

A turbomachine is provided. The turbomachine includes a rotor, a stator and a plurality of blade discs mounted on the rotor. The rotor includes a turbulator cylinder where a plurality of turbulators are provided on a curved surface of the turbulator cylinder and the stator includes an annular shroud extending around the turbulator cylinder. The plurality of turbulators increase a heat transfer to a coolant flowing between the adjacent opposed surfaces of the turbulator cylinder and the annular shroud.

9 Claims, 4 Drawing Sheets

TURBOMACHINE

CROSS REFERENCE TO RELATED APPLICATIONS

This application is the US National Stage of International Application No. PCT/EP2008/061508, filed Sep. 1, 2008 and claims the benefit thereof. The International Application claims the benefits of Great Britain application No. 0718997.0 GB filed Oct. 1, 2007. All of the applications are incorporated by reference herein in their entirety.

FIELD OF INVENTION

This invention relates to cooling of a turbomachine particularly but not exclusively in the field of a gas turbine where a slip ring arrangement is utilised to obtain data from sensors in the engine.

BACKGROUND OF INVENTION

Gas turbines run at very high temperatures and it is important to reduce heat transfer from the high temperature parts to sensitive components such as electronic instrumentation. Slip rings are provided on a shaft of the turbine to couple sensor outputs out of the engine via suitable cables. It is desirable that engine instrumentation using the sensor outputs is not exposed to the very high temperatures present in an operating engine.

SUMMARY OF INVENTION

The present invention arose in an attempt to reduce heat transfer between components and to reduce the temperature of components in a turbomachine.

According to the present invention there is provided a turbomachine comprising a stator, a rotor, and blade discs mounted on the rotor, the rotor being mounted for rotation about an axis, the rotation being relative to the stator, wherein the rotor includes a turbulator cylinder on the curved external surface of which is provided a plurality of turbulators, wherein the stator includes an annular shroud that extends around the turbulator cylinder, the turbulator cylinder and the annular shroud both being concentric with the axis of rotation of the rotor, a clearance being defined between adjacent opposed curved surfaces of the turbulator cylinder and annular shroud, wherein the plurality of turbulators provided on the curved external surface of the turbulator cylinder increase heat transfer to a coolant flowing between the adjacent opposed curved surfaces of the turbulator cylinder and annular shroud.

The turbulators increase a temperature gradient along the axis of the rotor and this gradient may be arranged to reduce the effect of heat on particular components which in the case of the specific embodiment are sensitive instrumentation components.

The turbulators may take a number of forms, for example, pips or surface indentations. The preferred form of the turbulators is a longitudinal rib. These may be provided at various angles relative to the axis of rotation of the rotor but in the preferred described embodiment the ribs are substantially parallel to the axis of rotation.

The turbulators may be milled into the surface of the turbulator cylinder or added to the surface and fixed thereto by welding.

The longitudinal rib height is preferably less than 0.3 times the clearance between the adjacent opposed curved surfaces of the turbulator cylinder and annular shroud. Preferably, the rib height is greater than 0.05 times the clearance.

Preferably, the rib height is given substantially by the relationship of rib pitch divided by a factor in this case ten.

BRIEF DESCRIPTION OF THE DRAWINGS

A specific embodiment of the invention will now be described with reference to the drawings in which.

DETAILED DESCRIPTION OF INVENTION

Figure 1:
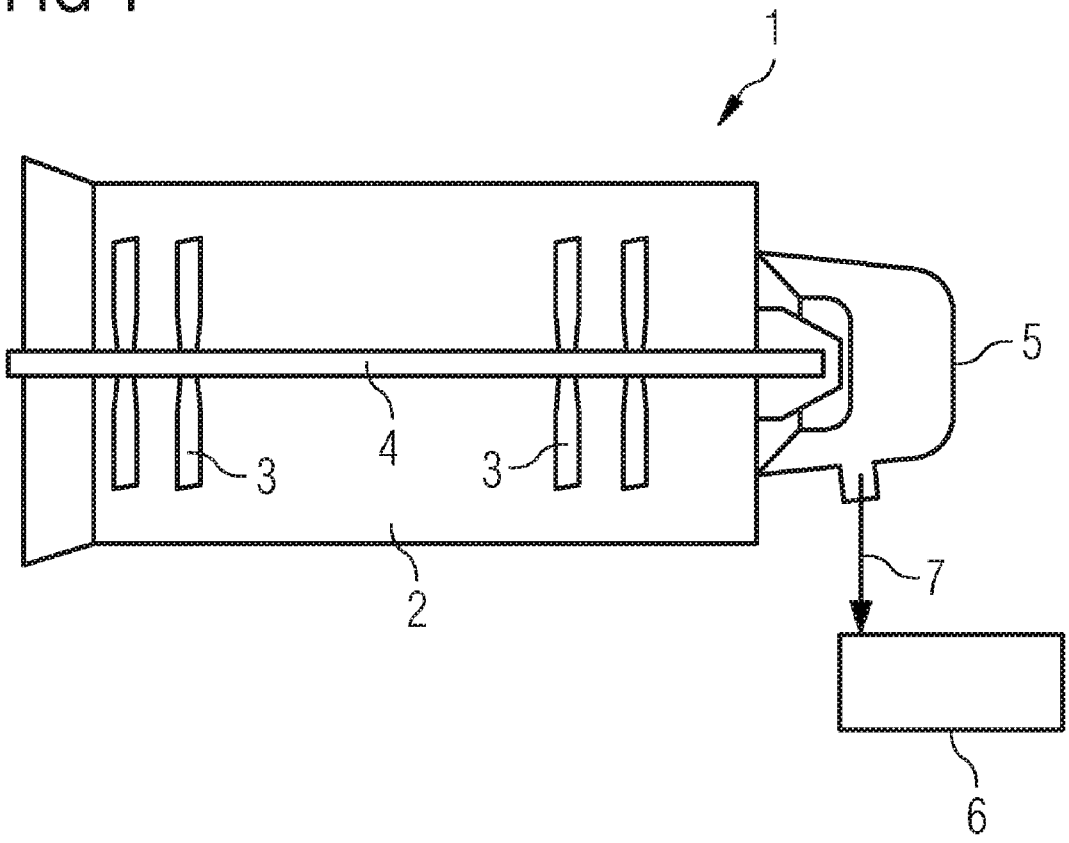
FIG. 1 shows in simplified form a turbomachine in accordance with the invention.

As is shown in FIG. 1, a turbomachine 1 is provided with an axial extending rotor 2 carrying blade discs 3 providing a compressor and turbine part. The rotor includes a tie bar 4 which extends into a downstream slip ring enclosure 5. The slip ring enclosure provides electrical connection between sensors with the turbomachine 1 and a set of instruments 6 by means of electrical cables 7.

Figure 2:
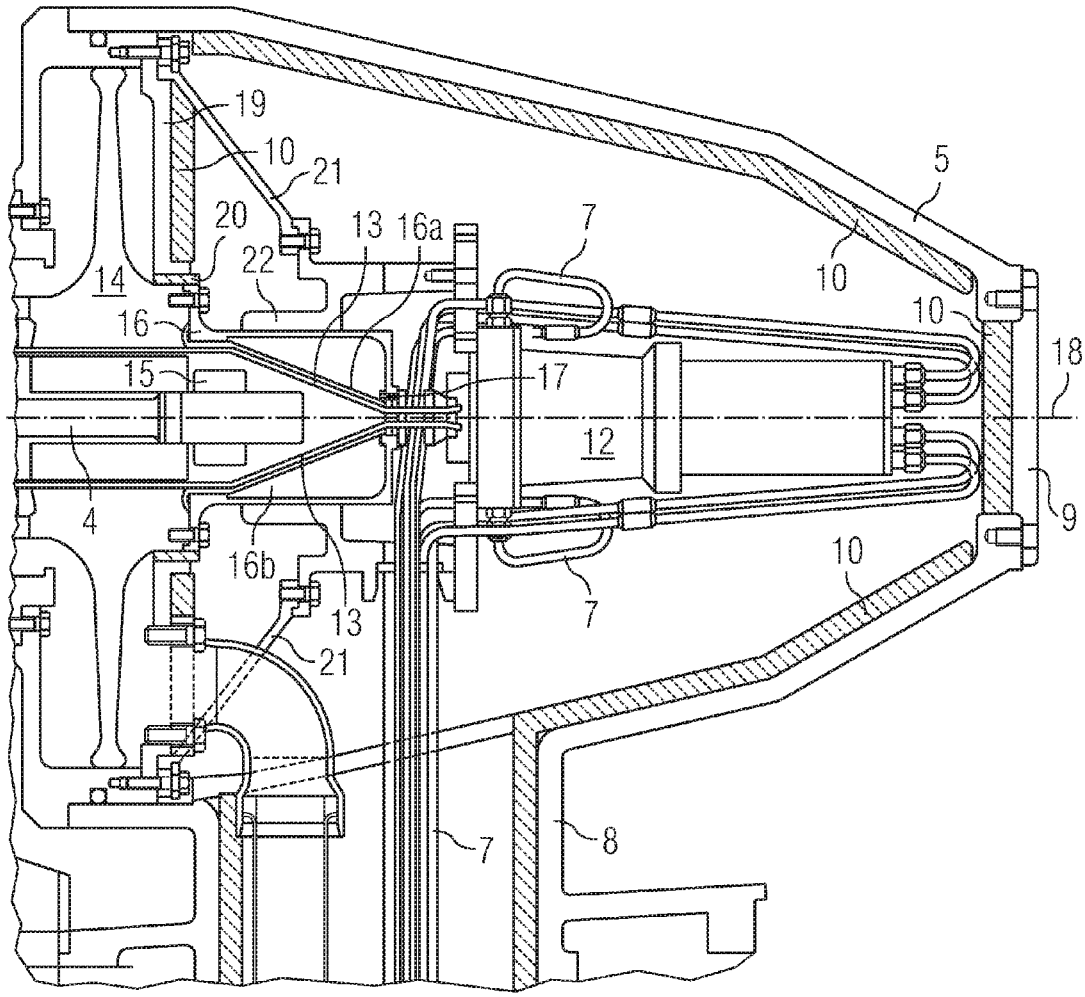
FIG. 2 shows a partial section through one end of the turbomachine of FIG. 1 showing a cooling arrangement in accordance with the invention, as well as a slip ring arrangement for sensor wires.

The slip ring enclosure 5 is shown in greater detail in FIG. 2. It comprises a generally truncated conical shaped shell having disposed to the lower side wall a cable and coolant duct 8 of generally cylindrical configuration which opens into the enclosure. An end plate 9 is provided bolted to the base apex of the conical shell. The inside of the walls of the enclosure are provided with an insulating material 10.

The enclosure 5 houses and protects a slip ring arrangement 12 which passes electrical signals to the cables 7 from a set of sensor wires 13 which pass into the turbomachine 1 and hence to sensors (not shown) distributed to sense parameters in the turbomachine 1. The sensed parameters can include temperature, for example.

The rotor 2 of the turbomachine protrudes into the enclosure 5. It comprises a balance piston 14 connected to the tie bar 4 by a tie bar nut 15. The balance piston 14 has bolted to it a turbulator cylinder 16. The turbulator cylinder 16 connects to a quill shaft 17 through which the sensor wires 13 are routed to the slip ring arrangement 12. It is important to note that these components are part of the rotor and rotate about the axis of rotation 18.

The turbulator cylinder 16 is generally cylindrical in configuration but includes an inner cone 16*a* which reduces in diameter left to right and provides an apex at the quill shaft 17. This creates a void 16*b* which reduces heat transfer through metal to metal contact and also by radiation as the cone 16*a* acts as a heat-shield. The cone 16*a* is spaced apart from the tie bar 4 and nut 15 and encloses it to further reduce heat transfer via conduction. It will be appreciated that some embodiments may not require this heat shield.

The rotor moves relative to a stator. This comprises a number of components which will be familiar to the person skilled in the art but in FIG. 2 there are shown an end plate 19 in the four of an annulus with the rotor 2 protruding through the central hole into the enclosure 5. A labyrinth seal 20 is provided to prevent hot gases escaping into the enclosure cavity. The end plate 19 is also insulated to prevent heat transmission.

Figure 3:
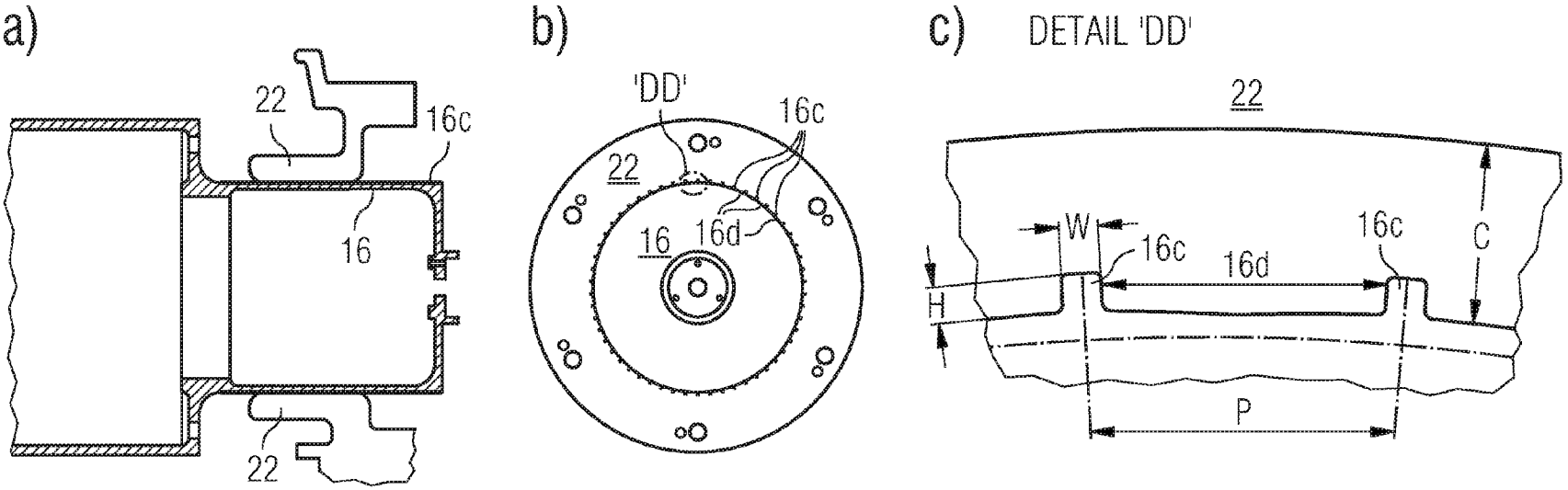
FIG. 3 shows a turbulator cylinder used in the turbomachine shown in FIG. 2 with FIG. 3*a* being a section along the axis of the rotor, FIG. 3*b* being an end view of the turbulator cylinder showing its relationship to a stator and FIG. 3*c* being an enlargement of region dd of the end view of FIG. 3*b* showing a detail of turbulator ribs on the turbulator cylinder.

The stator also includes a series of support spokes 21 two of which can be seen. These are fixed towards the radially outerwards part of the end plate 19 and are inclined inwards in a direction towards the axis of rotation 18. The radially inner ends of the spokes 21 are bolted to an annular shroud 22. This is provided with a central portion which is generally cylindrical which extends in a direction substantially parallel to the axis 18. This part of the arrangement is shown in greater detail in FIG. 3.

As is shown in FIGS. 3*a* and 3*b*, the turbulator cylinder 16, is provided with a plurality of turbulators in the form of ribs 16*c* milled into its surface. These extend in a parallel direction to the axis. FIG. 3*b* shows that the ribs 16*c* extend in a radial direction when examined end on from one side. There is a separation 16*d* between the ribs 16*c*. Two adjacent ribs are shown enlarged in FIG. 3*c*. It can be seen that they are generally rectangular in cross-section and project radially out of the surface on the turbulator cylinder 16. It will be seen that their outermost corner edges are radiused. This is preferred to enhance the coolant flow although other edge profiles may be used.

The preferred rib profile has rib height H from the surface of turbulator cylinder 16 to the radially outermost surface of the rib, a rib spacing or pitch given by the dimension P between the rib centre lines, a rib width of W and there is a clearance to the stator of C where in this case H is given by C/4 and the pitch to height ratio is 10. The geometric ranges may be P/H=range from 5 to 15, C/H=range from 0.1 to 0.5 and W/H=range from 0.3 to 3.0. In this particular case there are seventy two ribs, the pitch P is 5 mm, the height H is 0.55 to 0.75 mm, the rib width W is 0.5 to 0.75 mm, the clearance C is 1.6 mm The rib edges have a radius of 0.10 to 0.15 mm.

Figure 4:
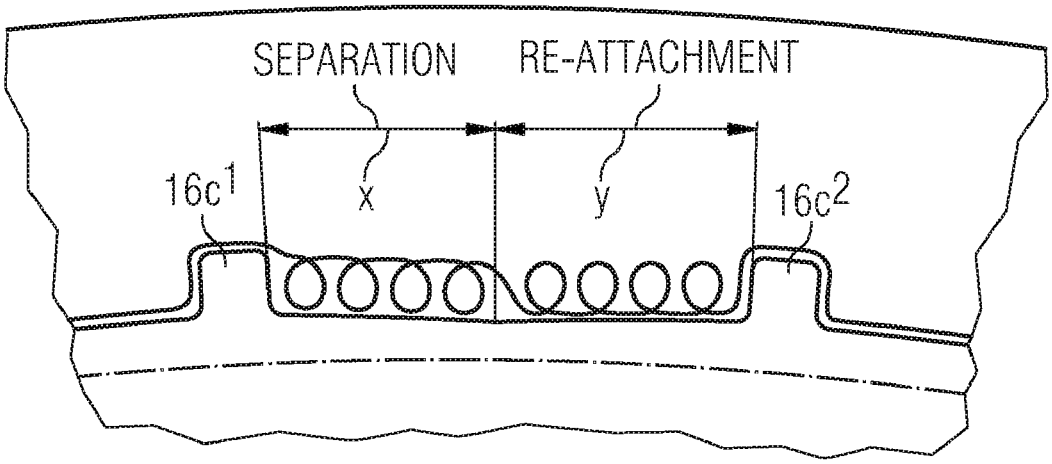
FIG. 4 is an explanatory drawing showing the effect of the turbulator ribs on a fluid flow.

The dimensions for the rib and pitch are chosen to facilitate efficient disturbance to the fluid flow and recombination of the flow to give enhanced cooling. This will now be described with reference to FIG. 4. The fluid flow is depicted by a simple line but the fluid flow is reality more complex than that depicted. However, as the fluid flow passes over the first rib $\mathbf{16}c^1$ it separates and turbulates over a separation region X and then reattaches over a region Y before flowing over the next rib $\mathbf{16}c^2$. Maximum cooling is effected over the re-attachment region Y. The chosen ratios of dimensions maximise the efficiency of this process.

In the specific embodiment of the invention the sensor signals are passed out of the turbomachine by a slip ring arrangement. It will be appreciated that other non contact methods may be used such as telemeters using wireless methods or memory devices to store the data until downloaded during service of the turbomachine.

In the described embodiment the ribs extend in a direction parallel to the axis of rotation. In alternative embodiments they may be arranged at any angle which may assist in promoting a coolant flow. The turbulators may be placed on the annular shroud in addition to the turbulator cylinder. These may be arranged at opposing angles to further enhance the coolant effect.

The invention claimed is:

1. A turbomachine comprising:

a rotor, comprising:

a turbulator cylinder whereby a plurality of turbulators are provided on a curved surface of the turbulator cylinder;

a stator, comprising:

an annular shroud extending around the turbulator cylinder; and a plurality of blade discs mounted on the rotor, wherein the rotor is mounted for rotation about an axis, the rotation is relative to the stator, wherein the annular shroud and the turbulator cylinder are concentric with the axis of rotation, wherein a clearance is defined between adjacent opposed curved surfaces of the turbulator cylinder and the annular shroud, and wherein the plurality of turbulators increase a heat transfer to a coolant flowing between the adjacent opposed curved surfaces of the turbulator cylinder and the annular shroud.

2. The turbomachine as claimed in claim 1, wherein each turbulator is a longitudinal rib.

3. The turbomachine as claimed in claim 2, wherein the longitudinal rib extends in a direction parallel to the axis of rotation.

4. The turbomachine as claimed in claim 1, wherein the plurality of turbulators include an essentially rectangular cross-section.

5. The turbomachine as claimed in claim 4, wherein at least one of a leading and a trailing edge of each turbulator includes a radiused profile.

6. The turbomachine as claimed in claim 1, wherein each turbulator includes a height which is essentially one quarter of the clearance.

7. The turbomachine as claimed in claim 1, wherein a ratio of a pitch of the plurality of turbulators to the height of the plurality of turbulators is 10 to 1.

8. The turbomachine as claimed in claim 1, wherein the plurality of turbulators are arranged to create a separation zone and a reattachment zone between successive turbulators for a coolant flow.

9. The turbomachine as claimed in claim 1, further comprising a heat shield located within the turbulator cylinder to prevent heat transfer to the turbulator cylinder.

* * * * *